United States Patent [19]

Piptone

[11] 4,422,786

[45] Dec. 27, 1983

[54] BIDIRECTIONAL MOTION TO UNIDIRECTIONAL MOTION TRANSLATOR

[75] Inventor: Paul J. Piptone, Houston, Tex.

[73] Assignee: Texas Instruments Incorporated, Dallas, Tex.

[21] Appl. No.: 202,995

[22] Filed: Nov. 3, 1980

[51] Int. Cl.[3] ..... B41J 33/14; B41J 33/04

[52] U.S. Cl. ..... 400/229; 400/196.1; 400/208; 400/236; 74/812

[58] Field of Search ..... 74/810, 812; 400/196.1, 400/208, 236, 229

[56] References Cited

U.S. PATENT DOCUMENTS

| | | | |
|---|---|---|---|
| 2,588,187 | 3/1952 | Weiser | 74/812 |
| 3,853,024 | 12/1974 | Vesci | 74/812 |
| 4,300,847 | 11/1981 | Hoffman et al. | 400/229 |

FOREIGN PATENT DOCUMENTS

| | | | |
|---|---|---|---|
| 850481 | 9/1952 | Fed. Rep. of Germany | 74/810 |
| 2119414 | 12/1972 | Fed. Rep. of Germany | 400/236 |
| 2820135 | 11/1979 | Fed. Rep. of Germany | 400/196.1 |
| 530137 | 11/1976 | U.S.S.R. | 74/810 |

OTHER PUBLICATIONS

IBM Technical Disclosure Bulletin, "Ribbon Drive", Darwin, vol. 19, No. 4, Sep. 1976, pp. 1407–1408.

*Primary Examiner*—Lawrence J. Staab

*Attorney, Agent, or Firm*—Thomas G. Devine; Leo N. Heiting; Melvin Sharp

[57] ABSTRACT

A motion translator is used in an impact printer of the type having a printhead and platen that move relative to each other, for driving the print ribbon in a single, fixed direction. A drive cable has each end connected to opposite sides of the frame of the printer and is wrapped 360° around a flange of the outer housing of the translator. The translator is rotatably mounted on the printhead carriage so that as the carriage moves relative to the platen, the housing is rotated by the drive cable. An upper clutch engages a driven, output shaft when the housing is rotated in one direction and does not engage the shaft when the housing is rotated in the opposite direction. A hubbed drive gear is positioned to rotate opposite the rotation of the housing. A lower clutch turns the driven, output shaft in the fixed direction when the housing rotates in the opposite direction by engaging the hub of the drive gear. When the housing is rotated in the one direction, the lower clutch does not engage. Therefore, the driven output shaft provides the fixed direction irrespective of the direction of motion between the printhead and platen.

5 Claims, 4 Drawing Figures

BIDIRECTIONAL MOTION TO UNIDIRECTIONAL MOTION TRANSLATOR

BACKGROUND OF THE INVENTION

1. Field of the Invention

This invention pertains to motion translators and more particularly to motion translators for translating bidirectional motion into unidirectional motion for moving a print ribbon in a fixed direction in an impact type printer irrespective of the direction of relative motion between the printhead and the platen.

2. Description of the Prior Art

In the past, impact printers have been designed to cause ribbon motion in one direction only when a character is being printed. Upon a carriage return, the ribbon is not moved.

Other prior art impact printers have ribbons that move continuously while normal printing is being done from left to right, and stop upon a carriage return.

Still other prior art impact printers are capable of printing from left to right and from right to left. In these prior art devices, however, the print ribbon is moved between reels.

Currently, many of the impact printers utilize a fixed direction ribbon movement in conjunction with a cartridge-type ribbon which is moved throughout its length and replaced when its entire length has been exhausted. This cartridge-type ribbon has many advantages including clean and easy replacement.

To utilize the cartridge concept, and yet to have forward and reverse printing capability, this invention enables the fixed direction of rotation of the print ribbon no matter which way the carriage is moving.

BRIEF SUMMARY OF THE INVENTION

A bidirectional to unidirectional translator provides a motive force to a ribbon cartridge from the movement of the carriage with respect to the platen of an impact printer. The print ribbon cartridge is activated by a rotational force in a fixed direction. The activating force to the translator is provided by the motion, in any direction, of the carriage relative to the platen. In this particular embodiment, the tranlator is used for the purposes described but, of course, it can be used for any other translation problem where it is desired to provide a fixed direction of rotation irrespective of the direction of the input motivating force.

The translator has an external housing which includes a hub and a grooved flange portion. The housing has a driven shaft about which it rotates, with the driven shaft providing a unidirectional output. The housing is rotatably mounted in a frame structure with the output end of the driven shaft rotatably mounted within an aperture in the top portion of the frame. The other end of the driven shaft terminates in a bearing at the opposite surface of the frame. The frame supports the printhead, rides on a pair of guided shafts and is propelled from right to left, and left to right, by an electric motor arrangement, well-known in the prior art.

A drive cable is wrapped 360° around the housing flange in the groove with one end attached to one side of the main frame of the printer and the other end attached to the other side of the main frame. As the carriage containing the printhead and translator moves from left to right, the housing is caused to rotate counterclockwise by the drive cable. When the carriage travels right to left, the housing is caused to rotate clockwise. The drive cable arrangement is merely one way of imparting a bilateral force to the translator. A rack and pinion could be applied as well.

A one-way clutch is located at the upper end of the drive shaft and engages the drive shaft as the carriage travels left to right, causing the drive shaft to rotate counterclockwise. As the carriage travels right to left, this upper clutch mechanism is disengaged.

A lower clutch is also provided and is located at the lower end of the driven shaft. The flange of the housing has an internal rim gear which engages an idler gear, which in turn engages a hubbed, drive gear. The drive gear turns in the opposite direction from the idler gear and therefore in the opposite direction from the rotational direction of the housing. As the carriage travels right to left, the housing rotates clockwise and the drive gear rotates counterclockwise. The drive gear hub is engaged by the lower clutch under these conditions and again the drive shaft is rotated in a counterclockwise direction.

When the housing rotates counterclockwise, the bottom clutch permits the driven shaft to slip and when the housing rotates in a clockwise direction, the upper clutch permits the driven shaft to slip. Therefore, the driven shaft maintains a counterclockwise rotation, regardless of the direction of rotation of the housing flange.

The selected counterclockwise rotation of the output ribbon shaft is, of course, arbitrary, and could as well have been a clockwise rotation.

A principle object of this invention is to provide a fixed, unidirectional output for moving a print ribbon from a bidirectional input provided by the relative motion between the carriage and the platen of an impact printer.

Another object of this invention is to provide an impact printer with a cartridge-type print ribbon that can be utilized for printing in both the forward and reverse direction.

These and other objects will be made evident in the detailed description that follows:

DETAILED DESCRIPTION

Figure 1:
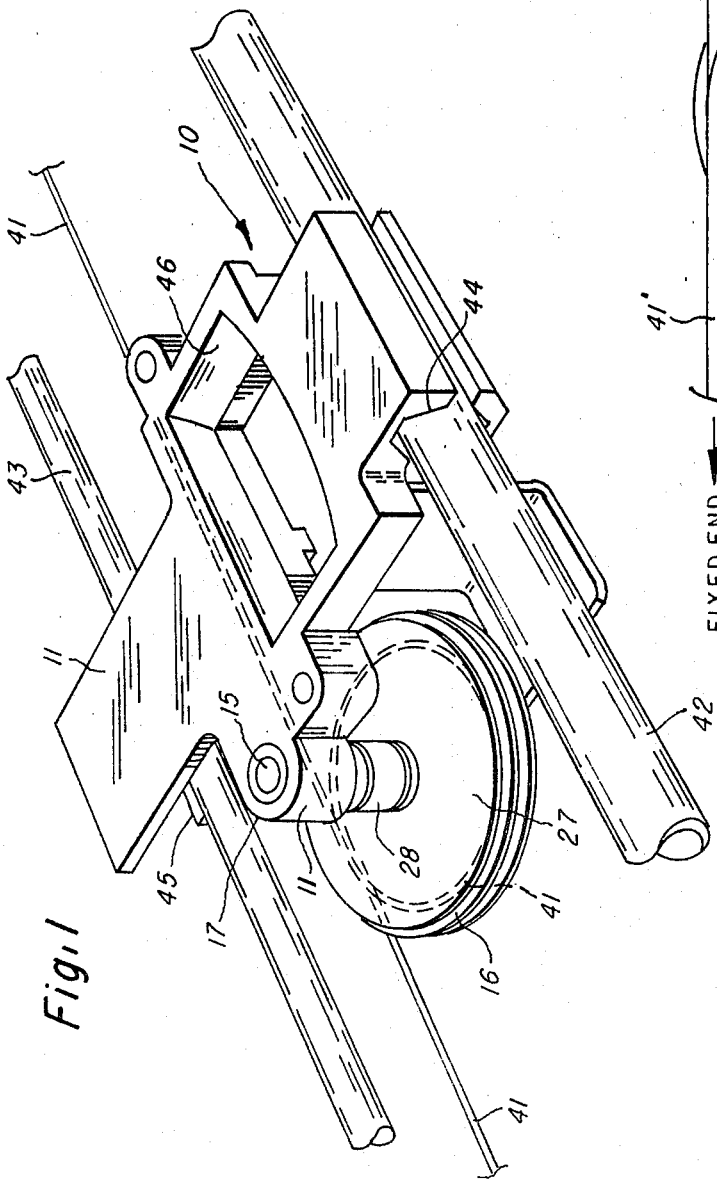
FIG. 1 is a perspective drawing of the translator in position in an impact printer.

FIG. 1 illustrates the translator and frame assembly 10 in position on guide rods 43 and 42 through guide surfaces 45 and 44 respectively of carriage 11. This assembly is for use typically within an impact printer terminal such as the Texas Instruments Incorporated type 820 Terminal. Carriage 11 has recess 46 for receiving a print head (not shown).

Translator 13 is shown in position having hub 28 and flange 27. Flange 27 contains groove 16 in which drive cable 41 is placed. Drive cable 41 is attached at each of its ends to the main frame of the impact printer and is shown wrapped 360° in the groove 16 around the flange 27 of translator 13. When the carriage 11 is moved along guides 43 and 42, the flange 27 and hub 28 will be rotated depending upon the direction of movement.

Output connection 15 is shown in which a splined shaft, such shaft providing the rotational force imparted to a print ribbon cartridge (not shown).

Figure 2:
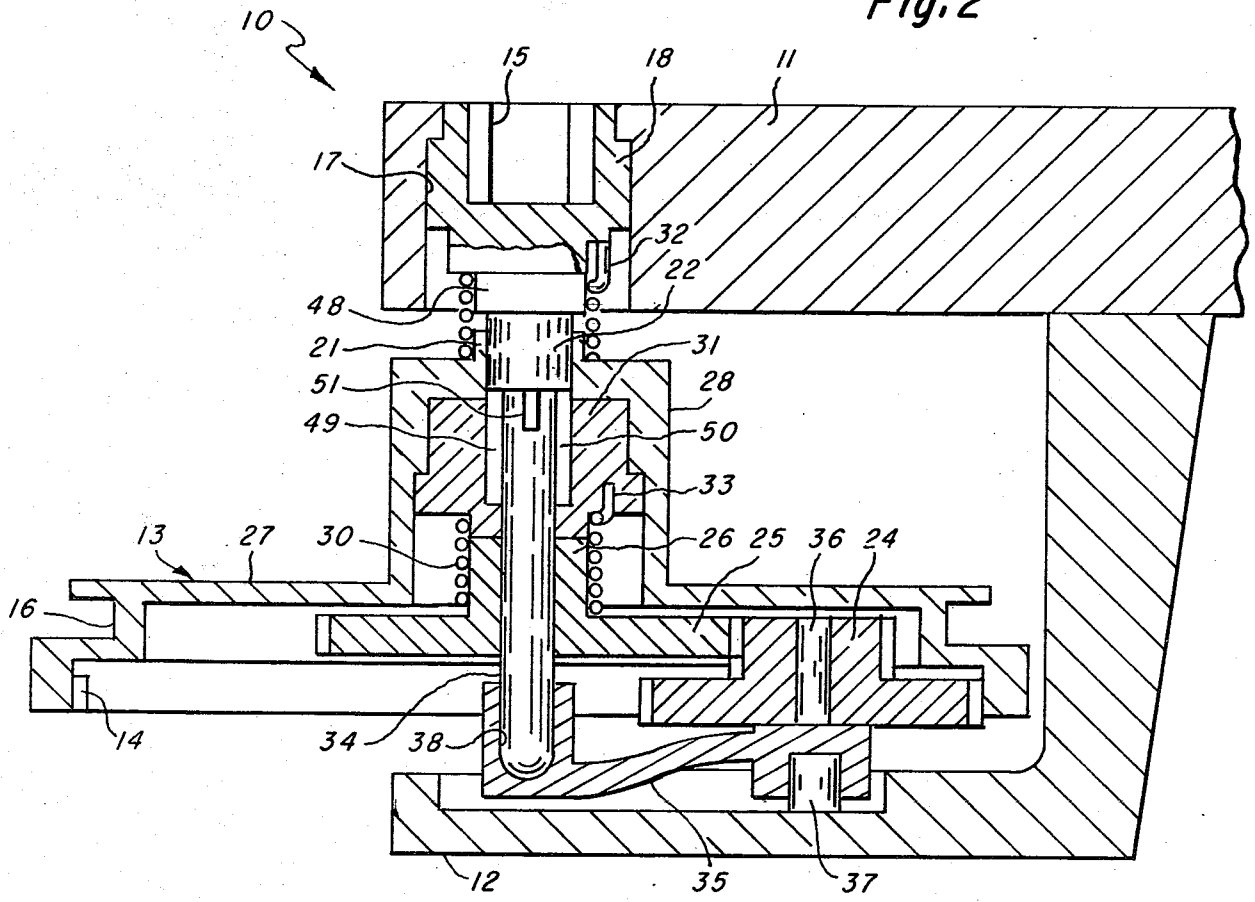
FIG. 2 is a cross-sectional view of the translator of this invention.

FIG. 2, in cross section, provides a comprehensive view of the components of the translator of this invention. The output bushing 15 is shown within the upper portion 18 of the driven shaft 34. Portion 18 fits within aperture 17 of carriage 11. Integral with upper portion 18 is shoulder 48 having a lesser diameter than upper portion 18, surrounded by upper clutch spring 20. The end of clutch spring 20 is anchored in slot 32 in upper portion 18. Integral with shoulder 48 is shoulder 22 having a smaller diameter than shoulder 48 and also having integral therewith splines 49, 50, and 51. Integral with the splines 49–51 and shoulder 22 is lower-driven shaft 34.

External housing 13 of the translator has flange 27 with circumferential groove 16 therein and rim gear 14 within its lower portion. Connected integral with flange 27 is hub 28 having shoulder 21 which is encompassed by upper clutch spring 20.

Shaft extension 31 is positively affixed to splines 49–51 of shaft 34 and is provided with slot 33 for anchoring lower clutch spring 30. Drive gear 25 having hub 26 is rotatably mounted on shaft 34 with hub 26 being surrounded by lower clutch spring 30. Drive gear 25 is driven by idler gear 24 which in turn is engaged by rim gear 14 of flange 27. Idler 24 rotates on axis 36 which is retained in bracket 35. Bracket 35 is retained by post 37 which in turn is connected to lower frame 12. Bearing surface 38 of bracket 35 contains the lower end of shaft 34.

MODE OF OPERATION

Figure 3:
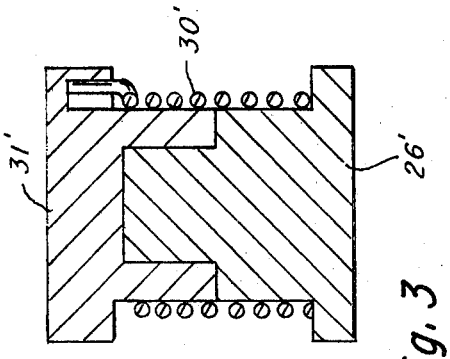
FIG. 3 illustrates a typical spring clutch.

FIG. 3 illustrates the spring clutch employed in this invention. Clutch spring 30' surrounds drive shaft 31' and driven shaft 26'. As drive shaft 31' rotates clockwise, spring 30' expands due to frictional forces and thus permits driven shaft 26' to rotate freely. However, when the shaft rotates counterclockwise, frictional forces act to contract the spring 30' around driven shaft 26'. This, in effect, acts as a locking device, or a one-way clutch which permits free rotation in only one location. In this preferred embodiment, left hand wound springs are employed so that counterclockwise rotation causes a locking effect. This, of course, could be directly reversed by using right-hand wound springs. It should also be noted that other one-way clutch devices are available and could be used, obviously, to replace the spring clutch herein described.

Figure 4:
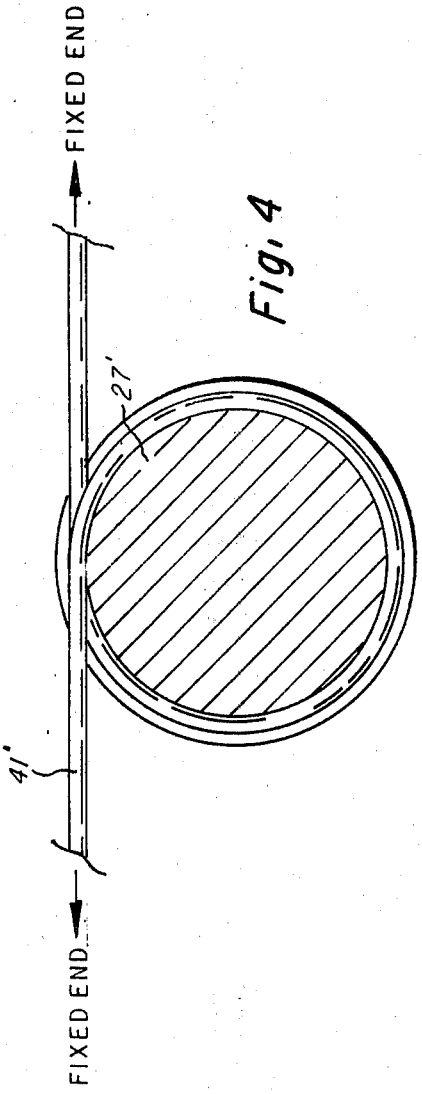
FIG. 4 illustrates the application of bilateral motion to the translator.

FIG. 4 is a top view of a flange 27' about which drive cable 41' is wrapped 360°. Flange 27' is rotatably mounted on a carriage which is moved to the left and to the right. As the carriage travels from left to right, flange 27' is rotated counterclockwise as a result of the wrap by drive cable 41' which is fixed at both ends. As the carriage travels right to left, flange 27' rotates clockwise.

These descriptions of FIGS. 3 and 4 apply to the operation of this invention and aid in the explanation of the apparatus of FIGS. 1 and 2.

Assuming first that the carriage is being moved left to right, flange 27 (see FIG. 1 and FIG. 2) is rotated counterclockwise. As housing 13 rotates counterclockwise, upper clutch spring 20 contracts about shoulder 21 on hub 28 of housing 13 causing driven shaft 34 to rotate counterclockwise. Upper portion 18 then rotates counterclockwise, as does output connection 15.

Also, as housing 13 rotates counterclockwise, internal rim gear 14 within flange 27 drives idler gear 24 counterclockwise which, in turn, drives drive gear 25 clockwise. As drive gear rotates clockwise, lower clutch spring 30 expands about hub 26 of gear 25 to rotate freely. As a result, only the upper clutch drives main shaft 34 (and output connection 15) in a counterclockwise direction, from the left to right carriage motion.

As carriage 11 travels right to left, outer housing 13 rotates clockwise, upper clutch spring 20 expands about shoulder 21 and housing 13 is permitted to rotate freely. Also, as housing 13 rotates clockwise the internal rim gear 14 in flange 27 drives idler gear 24 clockwise which, in turn, drives drive gear 25 counterclockwise. As drive gear 25 rotates counterclockwise, the lower clutch spring 30 contracts about hub 26 of gear 25, thus driving main shaft 34 (and output connection 15) again in the counterclockwise direction.

As can be seen, the translator can effectively transform rotation in either direction into shaft rotation in only one direction. The mechanism designed is versatile and the gears may be replaced by means which operate due to friction. For example, internal rim gear 14 and drive gear 25 may be replaced by high friction surfaces and idler gear 24 replaced by a rubber shaft. This arrangement relies upon the friction developed by two joining surfaces to generate the necessary action. Other adaptations may be made by those skilled in the art without departing from the scope of the appended claims.

What is claimed is:

1. A bidirectional motion to unidirectional motion translator in combination with an impact printer of the type utilizing a printhead and a platen, having a unidirectional print ribbon mechanism, wherein the translator is activated by the left to right and right to left motions of the printhead relative to the platen, the unidirectional output of the translator activating the print ribbon mechanism, comprising:

(a) a drive cable connected to opposite sides of the frame of the printer;

(b) rotationally mounted housing means, having an axial bore therethrough, and having a flange around which the driven cable is wound, relative in one direction or the opposite direction depending upon the relative direction of motion between the printhead and the platen and the resultant winding and unwinding of the drive cable;

(c) a driven shaft rotatably mounted within the bore of the housing means;

(d) upper clutch means positioned at the upper end of the driven shaft and adapted to selectively engage the driven shaft and the housing means, operable to turn the driven shaft in a fixed direction when the housing means rotates in the one direction, and to cause the driven shaft to slip when the housing means rotates in the opposite direction;

(e) rotational engaging means, rotated by the housing means in a direction opposite to that of the housing means; and (f) lower clutch means positioned at the lower end of the driven shaft and adapted to selectively engage the driven shaft and the rotational engaging means, operable to turn the driven shaft in the fixed direction when the housing means rotates in the opposite direction causing the engaging means to rotate in the one direction, and operable to cause the driven shaft to slip when the housing means rotates in the one direction causing the engaging means to rotate in the opposite direction, whereby the driven shaft rotates in the fixed direction when the housing means is rotated in either the one or the opposite direction.

2. The combination of claim 1 wherein the upper clutch means comprises an upper spring attached to the upper end of the driven shaft, surrounding the adjacent portion of the housing means, oriented to tighten around the adjacent portion when the housing means rotates in the one direction.

3. The combination of claim 1 wherein the lower clutch means comprises a lower spring attached to the driven shaft, surrounding a portion of the engaging means, oriented to tighten around the portion of the engaging means when the engaging means rotates in the one direction.

4. The combination of claim 2 wherein the lower clutch means comprises a lower spring, attached to the driven shaft, surrounding a portion of the engaging means, oriented to tighten around the lower when the engaging means rotates in the one direction.

5. The combination of claims 3 or 4 wherein the housing means comprises a hub through which the upper end of the driven shaft passes, and a flange, terminating at the lower end of the driven shaft, the flange having an internal rim gear, and wherein the rotational engaging means comprises:

(d) (i) an idler gear rotatably mounted to mesh with the internal gear and to rotate in the same direction as the housing means; and (ii) a drive gear having a hub, rotatably mounted to mesh with the idler gear and to turn in the opposite direction therefrom, wherein the lower spring is positioned to surround the hub and to tighten around the hub when the engaging means rotates in the one direction.

* * * * *